US008235234B2

(12) United States Patent
Kneer et al.

(10) Patent No.: US 8,235,234 B2
(45) Date of Patent: Aug. 7, 2012

(54) STOPPER FOR A CONTAINER

(75) Inventors: Roland Kneer, Farchant (DE); Frank Janssen, Bad Bayersoien (DE)

(73) Assignee: Gaplast GmbH, Altenau (DE)

( * ) Notice: Subject to any disclaimer, the term of this patent is extended or adjusted under 35 U.S.C. 154(b) by 799 days.

(21) Appl. No.: 12/297,450

(22) PCT Filed: Feb. 23, 2007

(86) PCT No.: PCT/DE2007/000348

§ 371 (c)(1),
(2), (4) Date: Oct. 17, 2008

(87) PCT Pub. No.: WO2007/118438

PCT Pub. Date: Oct. 25, 2007

(65) Prior Publication Data

US 2009/0101621 A1 Apr. 23, 2009

(30) Foreign Application Priority Data

Apr. 19, 2006 (DE) ..... 10 2006 018 449

(51) Int. Cl.
*B65D 39/00* (2006.01)

(52) U.S. Cl. ..... 215/355; 215/315; 222/511; 222/561; 220/345.1; 220/348

(58) Field of Classification Search ..... 215/315, 215/355; 220/345.1, 348; 222/511, 561
See application file for complete search history.

(56) References Cited

U.S. PATENT DOCUMENTS

| | | | | |
|---|---|---|---|---|
| 3,792,803 | A | 2/1974 | Kessler | |
| 5,299,702 | A * | 4/1994 | Kneer et al. | 215/256 |
| 5,752,612 | A * | 5/1998 | Fritzsche et al. | 215/301 |

FOREIGN PATENT DOCUMENTS

| | | |
|---|---|---|
| DE | 3336274 | 4/1985 |
| DE | 10023971 | 7/2001 |
| EP | 0 537 601 A1 | 4/1993 |
| EP | 0 609 955 A1 | 8/1994 |
| EP | 0 666 220 A1 | 8/1995 |
| GB | 13029 | 0/1911 |

* cited by examiner

*Primary Examiner* — Anthony Stashick
*Assistant Examiner* — Elizabeth Volz
(74) *Attorney, Agent, or Firm* — Greer Burns & Crain, Ltd.

(57) ABSTRACT

The stopper (2) engages with a ring-shaped neck in a press fit in a container (1) and has a circular bottom section which seals the container opening, and a head section which rises above the container and encompasses a slide (3) that extends through the center of the head section, the rim of the head section having a maximum diameter that does not exceed the external diameter of the container opening. The stopper is characterized in that the slide can be pushed against the force of a spring device in one direction over the rim of the container and, when released, returns to its retracted initial position as a result of the spring resistance. The stopper cannot be removed from the container by small children and is therefore considered childproof.

18 Claims, 3 Drawing Sheets

STOPPER FOR A CONTAINER

FIELD OF THE INVENTION

The present invention relates to a stopper for a container which preferably has a circular cylindrical shape with or without a container neck and is particularly intended for receiving pills, dragées or also other substances, for instance in powder or granular form. The stopper engages with a ring-shaped shoulder, which in cross section may have a bulged-out shape on the outside, into the container so that it can only be removed from the container by applying a force directed away from the container. Furthermore, the stopper comprises a circular bottom section which is integral with the ring-shaped shoulder and which seals the container opening, and a head section formed thereon, which rises above the container and in which a slide is displaceably arranged, the slide being adapted to be advanced or pushed forwards beyond the container rim and forming, in said position, a lever with which the stopper can be removed from the container.

BACKGROUND OF THE INVENTION

European patent EP 053 76 01, which goes back to the applicant of the present application, discloses a stopper in the head section of which such a slide is arranged. The slide has a recessed grip formed in the upper side, into which a user grips with one finger to push the slide forwards beyond the container rim. The slide in the retracted initial position is held by a projection on the bottom section of the stopper over which the slide can slide without the application of a considerable force. The recessed grip may catch an infant's attention, with the infant pushing the slide out of the head section and then being able to lever off the stopper from the container.

SUMMARY OF THE INVENTION

It is the object of the present invention to provide a stopper of the type under consideration, which is childproof, i.e., it is here ensured to a very high degree that infants cannot remove the stopper from the associated container so that they do not gain access to the container contents, which might be dangerous to their health.

This object is achieved according to the invention by a stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force.

According to the invention the slide can be pushed forwards against the force of a spring device in one direction beyond the rim of the container, and upon its release the slide returns into the retracted initial position as a result of the spring force.

Since the rim, which is preferably in the form of a truncated cone, of the head section of the stopper that rises above the container, and the correspondingly shaped end sections of the slide at both sides have a maximum diameter that does not exceed the external diameter of the container on the container opening, so that neither part of the stopper nor part of the slide in its retracted initial position rises above the container and can thus not be gripped from below for levering off the stopper, the stopper can only be levered off from the container with the help of the slide pushed forwards beyond the rim of the container. Even if an infant in playing with and manipulating the stopper noticed that the slide can be pushed forwards out of the head section of the stopper, the child would have to be able to hold the slide pushed forwards against the spring force in said position and simultaneously grip the slide with the other hand and prevent the same from bouncing back and, in addition, perform a lever movement away from the container to be able to remove the stopper. These processes are so complicated in their entirety that it can be assumed more or less for sure that an infant is not able to perform the same. The stopper according to the invention must thus be regarded as childproof.

At both axial ends the slide is provided with circumferential sections that smoothly fit into the rim of the head section of the stopper, which rim preferably has the form of a truncated cone. The circumferential section of the slide that is the rear one in the advance direction of the slide forms the surface of applied force for the advance movement thereof.

The rim of the head section may e.g. also have a cylindrical shape.

In a preferred embodiment of the invention the head section of the stopper contains two spaced-apart opposing side sections preferably identical in mirror symmetry, which are interconnected by an upper wall and together with said wall and the bottom wall of the stopper define a channel through which the slide extends. Expediently, it is not only the rear rim section of the slide, but also part of its upper side that is exposed while the upper wall of the stopper covers the remaining upper side of the slide, so that only its front bent face is exposed in the retracted initial position of the slide. The head section or the bottom wall of the stopper has expediently formed thereon a stop on which the slide is positioned biased by the spring device in the retracted initial position.

The spring device against the force of which the slide can be pushed out of the head section of the stopper and which makes the slide bounce back again into the retracted initial position immediately after the slide has been released can be configured in many ways. A separate component, e.g. made from a flexible metal, can be used as the spring device, which is operative between the slide and the stopper and gets elastically deformed upon the advance movement of the slide. Preferably, however, the spring device is made integral with the slide from an elastically deformable plastic material, an integral configuration with the stopper being in principle also within the scope of the invention.

The spring device may be formed by at least one elastically deformable web which is mounted or formed on the slide or on the stopper.

In a preferred embodiment of the invention the slide comprises two laterally free-cut, freely ending spring tabs which when the slide is pushed forwards are bent inwards by inwardly oriented wall sections of the side sections of the head section of the stopper, whereby a restoring force oriented towards the initial position is created. To this end the free-cut spring tabs may comprise outer contours which are oriented inwards towards their free end and are pressed inwards by obliquely inwardly directed wall sections of the side sections such that the slide upon its release by a user is pressed back along the obliquely inwardly oriented wall sections.

In this embodiment the front section of the slide is smaller than its rear remaining part, and a projection preferably formed on the bottom side of the upper wall of the head section of the stopper rests in the retracted initial position of the slide on a stop of the slide which is preferably formed by a vertical front boundary wall of a recess in the upper side of the slide, into which the projection of the upper wall of the stopper engages.

In a further, equally preferred embodiment of the invention, the slide contains a web which extends substantially in a direction transverse to its longitudinal axis and bulges outwards in the advance direction and which when the slide is pushed forwards is elastically pressed in by a stop which is preferably arranged on the circular bottom section of the stopper, whereby a restoring force directed towards the initial position is here also created, which upon release of the slide will have the effect that the slide bounces back into the initial position, while the web serving as a spring device resumes the bulged-out initial shape.

It goes without saying that also other elements that are elastically deformable when the slide is pushed forwards can provide for the automatic return of the slide.

The present invention also relates to the combination of a stopper configured according to the invention with an associated container on the upper rim or on the container neck of which, if such a neck is provided, an inner ring shoulder should be formed on which the bottom section of the stopper is positioned.

It should be noted that the features of the embodiments of the invention can be combined individually in any way.

BRIEF DESCRIPTION OF THE DRAWINGS

Further details of the invention become apparent from the following description of two preferred embodiments and from the drawings, in which.

DETAILED DESCRIPTION OF THE PREFERRED EMBODIMENTS

Figure 1A:
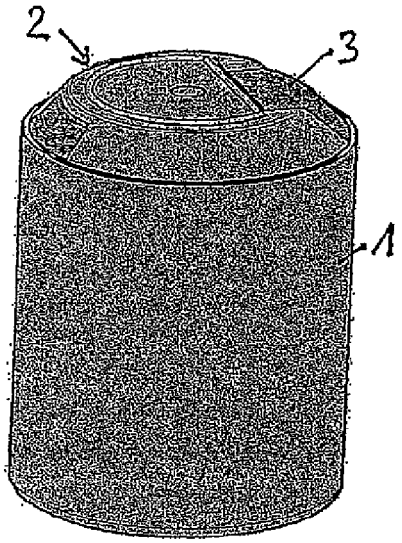
FIG. 1A is a perspective view of a container with a stopper having a slide which is in the retracted initial position.

FIG. 1A shows a container 1 which is sealed by a stopper 2 in which a slide 3 is centrally arranged, passing from one rim to the other rim. In the retracted initial position of the slide, which is shown in FIG. 1A, the visible part of the stopper together with the end-sided circumferential sections of the slide assumes an entirely continuous frustoconical shape, with the slide 3 on its rear section being moreover exposed with a part of its upper side.

The stopper 2 contains a circular bottom section 4 which seals the container 1 and is positioned with its rim on a ring shoulder 5 in the container wall, so that the circumference of the bottom section presents no possible means of attack for levering off the stopper.

The bottom section 4 has formed thereon a ring-shaped neck 6 whose curved outside 7 firmly rests on the inner wall of the container 1, whereby the stopper 2 is held in a fixed press fit in the container opening. In the inner wall of the container l. A surrounding recess may be formed for receiving a bulged-out section of the ring-shaped neck 6.

Radially inside the ring-shaped neck 6, a further ring-shaped neck 8 is provided, which is formed on the bottom section 6 and intended as a drying agent chamber.

Towards the upper side, the bottom section 4 has formed thereon a head section 9 which rises above the container rim and contains two spaced-apart opposing side sections 10 in mirror symmetry which are interconnected by an upper wall 11, with the upper wall 11, the two side sections 10 with their longitudinally oriented side walls 12 and the bottom section 4 of the stopper 2 defining a channel through which the slide 3 extends.

Figure 1B:
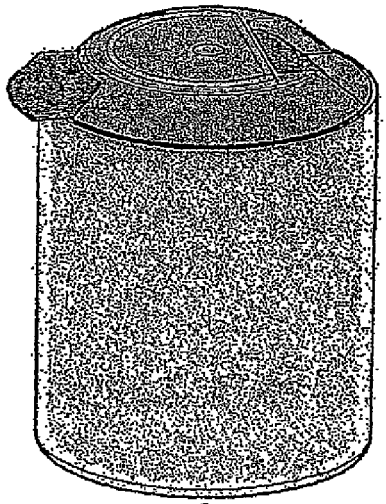
FIG. 1B is a perspective view similar to FIG. 1A, but with the slide being advanced or pushed forwards.
Figure 1C:
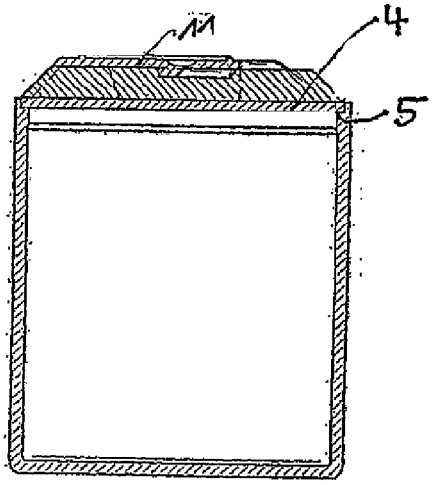
FIG. 1C is a vertical section through the combination consisting of container and stopper according to FIG. 1A.
Figure 1D:
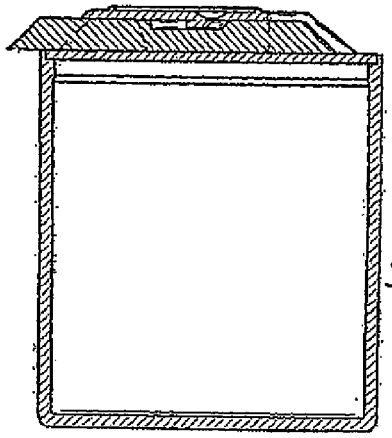
FIG. 1D is a vertical section through the combination consisting of container and stopper according to FIG. 1B.
Figure 1F:
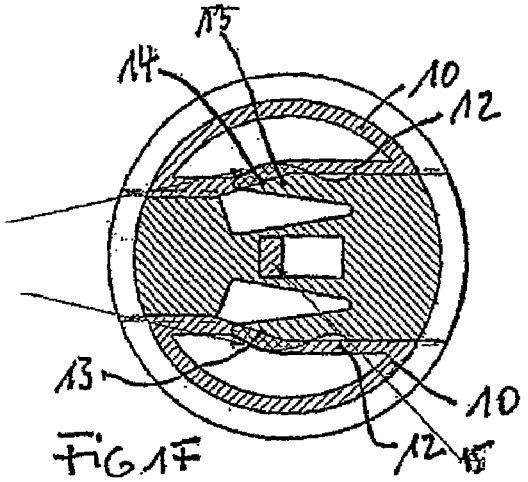
FIG. 1F is a section along line A-A in FIG. 1E.
Figure 1E:
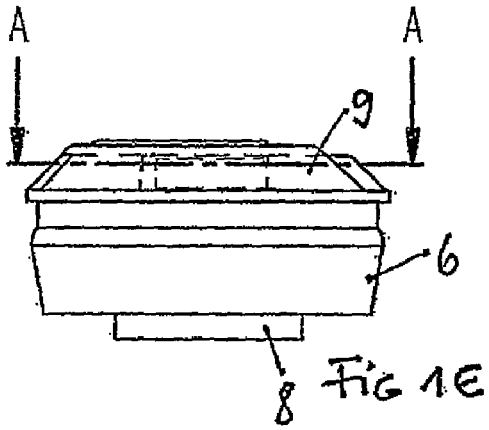
FIG. 1E is a side view of the stopper with the slide positioned in the retracted initial position.
Figure 1H:
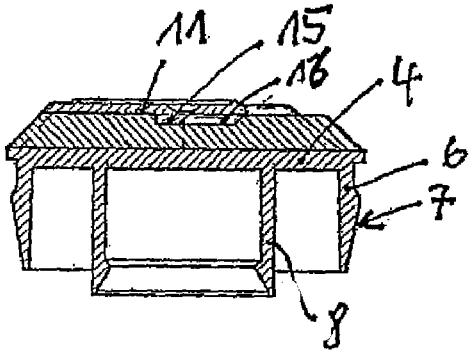
FIG. 1H is a section through the slide along line B-B in FIG. 1G.

The slide 3 contains two laterally free-cut, freely ending webs 13, which are shown in FIG. 1F in their non-deformed initial state. The two laterals webs 13 have a curved outer contour tapering inwards towards the free end. In contrast to the illustration of FIG. 1F the two outsides of the webs 13 rest on wall sections 14 of the side walls 12 that in the illustration of FIG. 1F extend to the left (i.e. towards the advance side of the slide) obliquely inwards, whereby the webs 13 are forced inwards. When the stopper 3 is pushed forwards to the left, this is carried out under elastic deformation of the two webs 13 that at the same time due to the shape of their outer contours and in cooperation with the oblique extension of the side walls 12 of the stopper develop a restoring force directed to the right side, so that upon release of the stopper the latter will immediately bounce back into the initial position. The advanced end position and the retracted end position are here defined by the engagement of a lower projection 15 of the upper wall 11 of the stopper into a longitudinal recess 16 in the upper side of the slide 3.

Figure 1G:
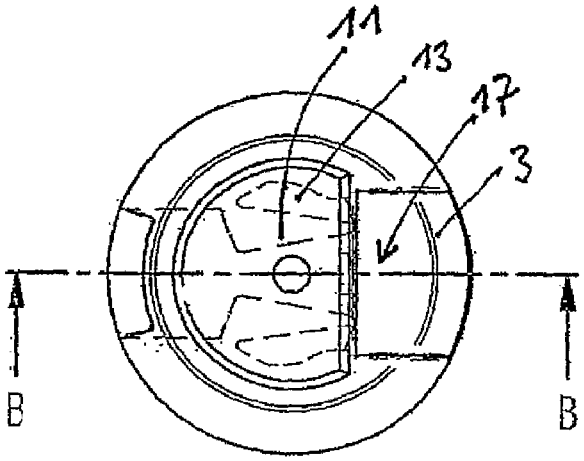
FIG. 1G is a top view on the slide.

As shown in FIG. 1G, part of the upper side of the slide 3, which is indicated by reference numeral 17 on the whole, is exposed in this embodiment.

FIGS. 1B and 1D show the advanced position of the slide in which said slide can be gripped on its projecting part from below to lift off the stopper from the container. The slide must here be held against the spring force in the advanced position, which an infant is not able to do.

Figure 2A:
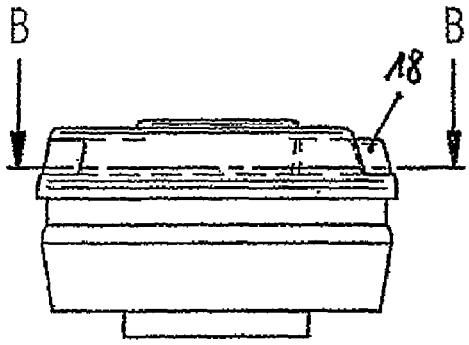
FIG. 2A is a side view of a second embodiment of the stopper with slide.
Figure 2B:
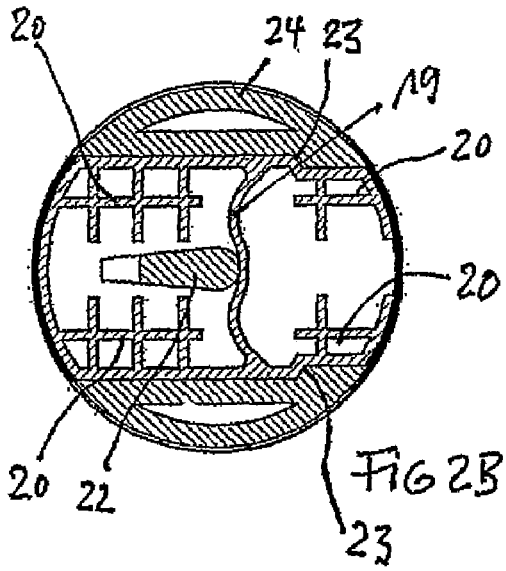
FIG. 2B is a horizontal section through the stopper along line B-B in FIG. 2A.
Figure 2C:
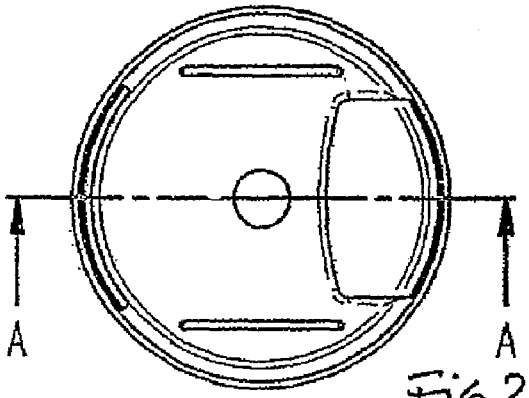
FIG. 2C is a top view on the second embodiment of the stopper.
Figure 2D:
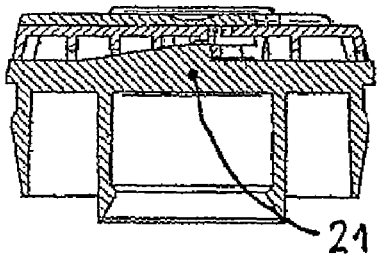
FIG. 2D is a vertical section along line A-A in FIG. 2C.

FIGS. 2A to 2D show a second embodiment of the stopper of the invention with slide. In this embodiment the slide 18 is provided with a bulged-out web 19 which extends substantially in a direction transverse to the longitudinal axis of the slide and which has a central indentation and, like the webs 13 of the above-described first embodiment, are made from an elastically deformable plastic material. As shown in FIG. 2B, the web 19 passes at its two ends at an angle of about 45° into the side walls of the slide, which is provided on the bottom side with a plurality of further webs 20 which permit the displacement of the slide 18 relative to a stop 22 formed on the bottom section 21.

When the slide 18 in the illustrations of FIG. 2 is pushed out of the head section of the stopper to the left side, the web 19 is elastically pushed back, with the web 19 immediately resuming its initial shape upon release of the slide by a user, thereby moving the slide back into the illustrated initial position. In this embodiment the slide 18 rests with shoulders 23 at both sides on corresponding shoulders of the side sections 24 of the stopper, whereby the spring-loaded initial position of the slide is defined.

The slide is preferably made of PP or POM while the stopper is preferably made from HDPE without the invention being limited to these materials.

The invention claimed is:

1. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, the spring device being formed by at least one elastically deformable web which is mounted or formed on the slide or on the stopper, wherein opposing sides of the slide each end in circumferential sections, a first one of said circumferential sections forming an outer surface for receiving a first applied force for advancing the slide and causing said second one of said circumferential sections to protrude from the stopper, said second one of said circumferential sections receiving a second different applied force to remove the stopper from the container, the slide comprising two laterally free-cut, freely ending spring tabs which when the slide is pushed forwards are bent inwards by obliquely inwardly directed wall sections of the side sections, wherein a restoring force directed towards the initial position is created, and wherein the spring tabs have curved outer contours tapering inwards towards the free end.

2. The stopper according to claim 1, wherein the head section of the stopper comprises two spaced-apart side sections which are interconnected by an upper wall and together with said wall and the bottom wall define a channel through which the slide extends.

3. The stopper according to claim 1, wherein a front section of the slide is smaller than the rear remaining part of the slide and a projection formed on the bottom side of the upper wall rests, in the retracted initial position of the slide, on a stop of the slide.

4. The stopper according to claim 1, wherein the upper side of the slide is without recessed grips or projections.

5. A combination consisting of a stopper according to claim 1 and a container, said container including an inner ring shoulder on which the bottom section of the stopper is positioned.

6. The stopper according to claim 1, wherein in the retracted initial position the slide together with the head section forms a conjoint circumferential rim and that the slide ends at both sides in circumferential sections of the rim.

7. The stopper according to claim 6, wherein the circumferential rim is tapering towards the upper side in the form of a truncated cone.

8. The stopper according to claim 1, wherein the slide comprises a web which extends substantially in a direction transverse to the longitudinal axis thereof and is bulged out in an advanced direction and which when the slide is pushed forwards is elastically pressed in by a stop preferably arranged on the bottom section of the stopper, whereby a restoring force directed towards the initial position is created.

9. The stopper according to claim 8, wherein a front section of the slide is broader than the rear remaining part of the slide and in the retracted initial position of the slide, the slide resting on side sections of the stopper.

10. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, the spring device being formed by at least one elastically deformable web which is mounted or formed on the slide or on the stopper, wherein opposing sides of the slide each end in circumferential sections, a first one of said circumferential sections forming an outer surface for receiving a first applied force for advancing the slide and causing said second one of said circumferential sections to protrude from the stopper, said second one of said circumferential sections receiving a second different applied force to remove the stopper from the container, and wherein the slide comprises a web which extends substantially in a direction transverse to the longitudinal axis thereof and is bulged out in an advanced direction and which when the slide is pushed forwards is elastically pressed in by a stop preferably arranged on the bottom section of the stopper, whereby a restoring force directed towards the initial position is created.

11. The stopper according to claim 10, wherein a front section of the slide is broader than the rear remaining part of the slide and in the retracted initial position of the slide, the slide rests on side sections of the stopper.

12. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, said spring device being formed by at least one elastically deformable web which is mounted or formed on the slide or on the stopper, said slide including two laterally free-cut, freely ending spring tabs which when the slide is pushed forwards are bent inwards by obliquely inwardly directed wall sections creating a restoring force directed towards the initial position, wherein the spring tabs have curved outer contours tapering inwards towards the free end.

13. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, said spring device being formed by at least one elastically deformable web which is mounted or formed on the slide or on the stopper, said slide including a web extending substantially in a direction transverse to the longitudinal axis thereof and is bulged out in advance direction and which when the slide is pushed forwards is elastically pressed in by a stop preferably arranged on the bottom section of the stopper, whereby a restoring force directed towards the initial position is created.

14. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, said spring device being formed by at least one elastically deformable web which is mounted or formed on the slide or on the stopper, said slide including two laterally free-cut, freely ending spring tabs which when the slide is pushed forwards are bent inwards by obliquely inwardly directed wall sections creating a restoring force directed towards the initial position, wherein a front section of the slide is smaller than the rear remaining part of the slide and a projection formed on the bottom side of the upper wall rests, in the retracted initial position of the slide, on a stop of the slide.

15. A stopper which engages with a ring-shaped neck in a press fit into a container, comprising a circular bottom section which seals the container opening, and a head section which rises above the container and encompasses a slide having an upper side and extending through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, wherein the upper side of the slide is without at least one of recessed grips and projections.

16. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, the spring device being formed by at least one elastically deformable web which is mounted or formed on the slide or on the stopper, wherein opposing sides of the slide each end in circumferential sections, a first one of said circumferential sections forming an outer surface for receiving a first applied force for advancing the slide and causing said second one of said circumferential sections to protrude from the stopper, said second one of said circumferential sections receiving a second different applied force to remove the stopper from the container, wherein the slide comprises two laterally free-cut, freely ending spring tabs which when the slide is pushed forwards are bent inwards by obliquely inwardly directed wall sections of the side sections, whereby a restoring force directed towards the initial position is created, and wherein a front section of the slide is smaller than the rear remaining part of the slide and a projection formed on the bottom side of the upper wall rests, in the retracted initial position of the slide, on a stop of the slide.

17. A stopper which engages with a ring-shaped neck in a press fit into a container, comprising a circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, wherein opposing sides of the slide each end in circumferential sections, a first one of said circumferential sections forming an outer surface for receiving a first applied force for advancing the slide and causing said second one of said circumferential sections to protrude from the stopper, said second one of said circumferential sections receiving a second different applied force to remove the stopper from the container, wherein an upper side of the slide is without recessed grips or projections.

18. A container including a stopper, said container including an inner ring shoulder on which the bottom section of the stopper is positioned, said stopper engaging a ring-shaped neck in a press fit into the container, said stopper comprising a .circular bottom section which seals the container opening, and a head section which rises above the container and encompasses a slide that extends through the center of the head section, the rim of the head section having a maximum diameter that does not exceed the external diameter of the container on the container opening, wherein the slide can be pushed against the force of a spring device in one direction over the rim of the container and, when released, returns to its retracted initial position as a result of the spring force, wherein opposing sides of the slide each end in circumferential sections, a first one of said circumferential sections forming an outer surface for receiving a first applied force for advancing the slide and causing said second one of said circumferential sections to protrude from the stopper, said second one of said circumferential sections receiving a second different applied force to remove the stopper from the container.

* * * * *